US010370909B2

(12) United States Patent
Thomas et al.

(10) Patent No.: US 10,370,909 B2
(45) Date of Patent: Aug. 6, 2019

(54) ENHANCED SLICKLINE

(71) Applicant: Halliburton Energy Services, Inc., Houston, TX (US)

(72) Inventors: Sean Gregory Thomas, Frisco, TX (US); Wei Zhang, Plano, TX (US); David L. Perkins, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 117 days.

(21) Appl. No.: 15/323,656

(22) PCT Filed: Aug. 4, 2014

(86) PCT No.: PCT/US2014/049618
§ 371 (c)(1),
(2) Date: Jan. 3, 2017

(87) PCT Pub. No.: WO2016/022094
PCT Pub. Date: Feb. 11, 2016

(65) Prior Publication Data

US 2017/0159375 A1 Jun. 8, 2017

(51) Int. Cl.
*E21B 17/20* (2006.01)
*D07B 1/16* (2006.01)
(Continued)

(52) U.S. Cl.
CPC ..... *E21B 17/20* (2013.01); *D07B 1/145* (2013.01); *D07B 1/162* (2013.01); *E21B 19/08* (2013.01);
(Continued)

(58) Field of Classification Search
CPC ..... E21B 17/20; E21B 19/08; E21B 23/14; E21B 47/00; E21B 19/084; E21B 23/00;
(Continued)

(56) References Cited

U.S. PATENT DOCUMENTS 4,689,552 A 8/1987 Fujii et al.
6,317,540 B1 11/2001 Foulger et al.
(Continued)

FOREIGN PATENT DOCUMENTS

WO 2002/026468 A2 4/2002

OTHER PUBLICATIONS

International Preliminary Report on Patentability issued in related Application No. PCT/US2014/049618, dated Feb. 16, 2017 (12 pages).
International Search Report and Written Opinion issued in related PCT Application No. PCT/US2014/049618 dated Apr. 29, 2015, 16 pages.

*Primary Examiner* — Jenny L Wagner
(74) *Attorney, Agent, or Firm* — Alan Bryson; Baker Botts L.L.P.

(57) ABSTRACT

In accordance with embodiments of the present disclosure, a slickline for use in well drilling and hydrocarbon recovery operations includes a cable and an intermediate layer disposed around the cable. The slickline also includes a doped polymeric coating layered around the intermediate layer. The doped polymeric coating is a different material from the intermediate layer, and the doped polymeric coating includes a polymeric material doped with an element that is detectable within the doped polymeric coating via a detection machine for purposes of determining wear or other aspects about the conditions of the slickline.

20 Claims, 6 Drawing Sheets

(51) Int. Cl.

| | |
|---|---|
| ***E21B 23/14*** | (2006.01) |
| ***D07B 1/14*** | (2006.01) |
| ***E21B 19/08*** | (2006.01) |
| ***E21B 47/00*** | (2012.01) |

(52) U.S. Cl.
CPC ..... *E21B 23/14* (2013.01); *E21B 47/00* (2013.01); *D07B 1/147* (2013.01); *D07B 2201/2087* (2013.01); *D07B 2201/2088* (2013.01); *D07B 2201/2092* (2013.01); *D07B 2201/2096* (2013.01)

(58) Field of Classification Search
CPC ..... D07B 1/145; D07B 1/162; D07B 1/147; D07B 2201/2087; D07B 2201/2088; D07B 2201/2092; D07B 2201/2096; G01T 1/36; H01B 7/18; G01J 1/04; G01J 1/42; G01N 23/223; G01R 31/12
USPC ..... 174/98, 102 R, 106 R, 110 R, 110 SC, 174/113 R, 120 R, 120 SC, 103, 105, 107, 174/108
See application file for complete search history.

(56) References Cited

U.S. PATENT DOCUMENTS

| | | | | |
|---|---|---|---|---|
| 6,960,724 | B2 * | 11/2005 | Orlet | H01B 7/046 174/102 R |
| 7,154,081 | B1 | 12/2006 | Friedersdorf et al. | |
| 7,170,007 | B2 * | 1/2007 | Varkey | H01B 7/046 174/102 R |
| 7,184,515 | B2 * | 2/2007 | Wilson | G01N 23/223 378/44 |
| 7,462,781 | B2 * | 12/2008 | Varkey | H01B 7/046 174/102 R |
| 7,541,543 | B2 * | 6/2009 | Head | E21B 17/206 174/102 R |
| 8,227,697 | B2 * | 7/2012 | Varkey | H01B 7/046 174/102 R |
| 9,412,492 | B2 * | 8/2016 | Varkey | H01B 7/046 |
| 9,859,037 | B2 * | 1/2018 | Varkey | H01B 3/30 |
| 2006/0067465 | A1 * | 3/2006 | Wilson | G01N 23/223 378/47 |
| 2010/0012348 | A1 * | 1/2010 | Varkey | H01B 7/046 174/106 R |

* cited by examiner

FIG. 2
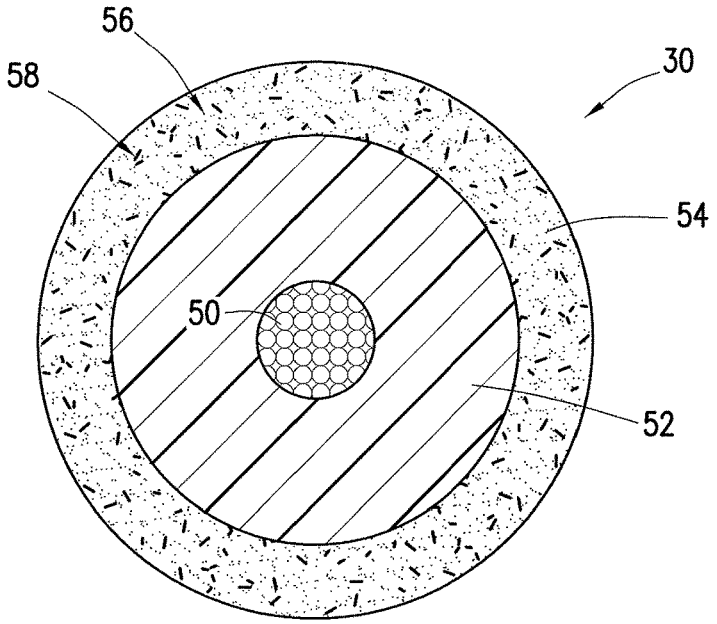
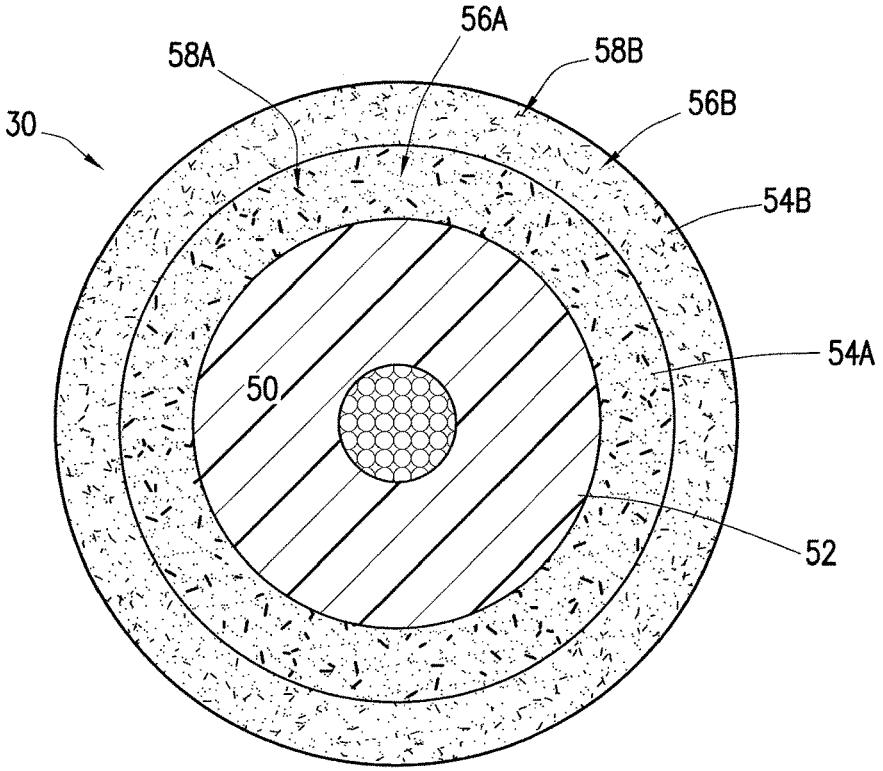
FIG. 3

FIG. 6
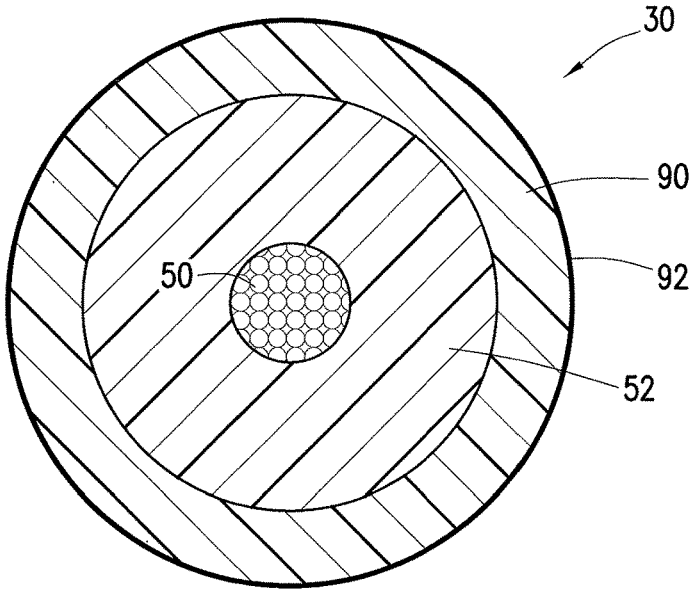
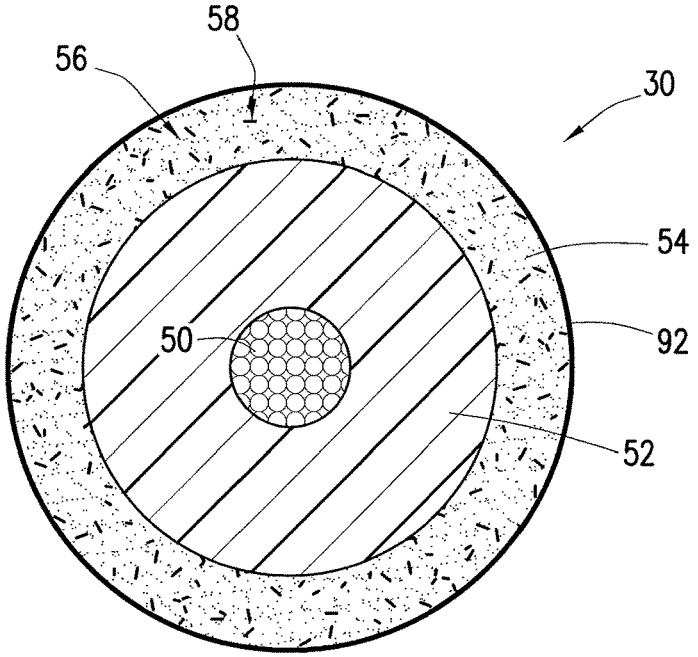
FIG. 7

ENHANCED SLICKLINE

CROSS-REFERENCE TO RELATED APPLICATION

The present application is a U.S. National Stage Application of International Application No. PCT/US2014/049618 filed Aug. 4, 2014, which is incorporated herein by reference in its entirety for all purposes.

TECHNICAL FIELD

The present disclosure relates generally to well drilling, hydrocarbon recovery, and well intervention operations and, more particularly, to enhanced coatings of a slickline used in well drilling and hydrocarbon recovery operations.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. For example, temporary packers may be set in the wellbore during the completion and production operating phases of the wellbore. In addition, various operating tools including flow controllers (e.g., chokes, valves, etc.) and safety devices such as safety valves may be releasably positioned in the wellbore. Such tools are often lowered downhole by a wireline, a work string, or a slickline and may be configured with a fishing neck to facilitate recovery at a later time. Once downhole, the tool may be set at a desired location and released, allowing the wireline, work string, or slickline to be retrieved.

As noted above, a slickline can be used to lower and retrieve wellbore tools from the wellbore. A slickline generally includes a nonelectric cable with a polymeric coating to protect the cable from mechanical wear during deployment and retraction from the wellbore. The polymeric coating may include additives such as Teflon to prevent mechanical wear on the slickline. However, it is now recognized that there exists a need for a method for identifying and evaluating damage to the slickline coating.

BRIEF DESCRIPTION OF THE DRAWINGS

For a more complete understanding of the present disclosure and its features and advantages, reference is now made to the following description, taken in conjunction with the accompanying drawings, in which:

FIG. 2 is a schematic cross-sectional view of the slickline of FIG. 1 having a doped polymeric coating, in accordance with an embodiment of the present disclosure;

FIG. 3 is a schematic cross-sectional view of the slickline of FIG. 1 having two doped polymeric coatings, in accordance with an embodiment of the present disclosure;

FIG. 6 is a schematic cross-sectional view of the slickline of FIG. 1 having a coated polymeric layer, in accordance with an embodiment of the present disclosure;

FIG. 7 is a schematic cross-sectional view of the slickline of FIG. 1 having a doped and coated polymeric layer, in accordance with an embodiment of the present disclosure.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to slicklines used in well drilling and hydrocarbon recovery operations, these slicklines having enhanced outer coatings. These coatings may include polyether ether ketone (PEEK), or some other polymer, with additives in the form of dopants, layered dopants, coatings, or a combination thereof. The additives may provide additional functionalities to the PEEK coating of the slickline. For example, the addition of hydrophobic or hydrophilic coatings to the PEEK layer may enable resistance or acceptance of various wellbore fluids. In addition, the PEEK layer may be doped with conductive elements or elemental tracers that can be used for identification and analysis of the coating, such as tagging specific locations on the slickline or detecting damage to the coating. A machine designed to detect the elemental tracers or conductive elements in the PEEK coating may provide these and similar evaluations. By keeping wellbore fluids out of the slickline and providing methods for detecting wear on the slickline coating, these additives to the outer layers of the slickline may facilitate a longer life of the slickline than would be available using conventional slickline coatings.

Figure 1:
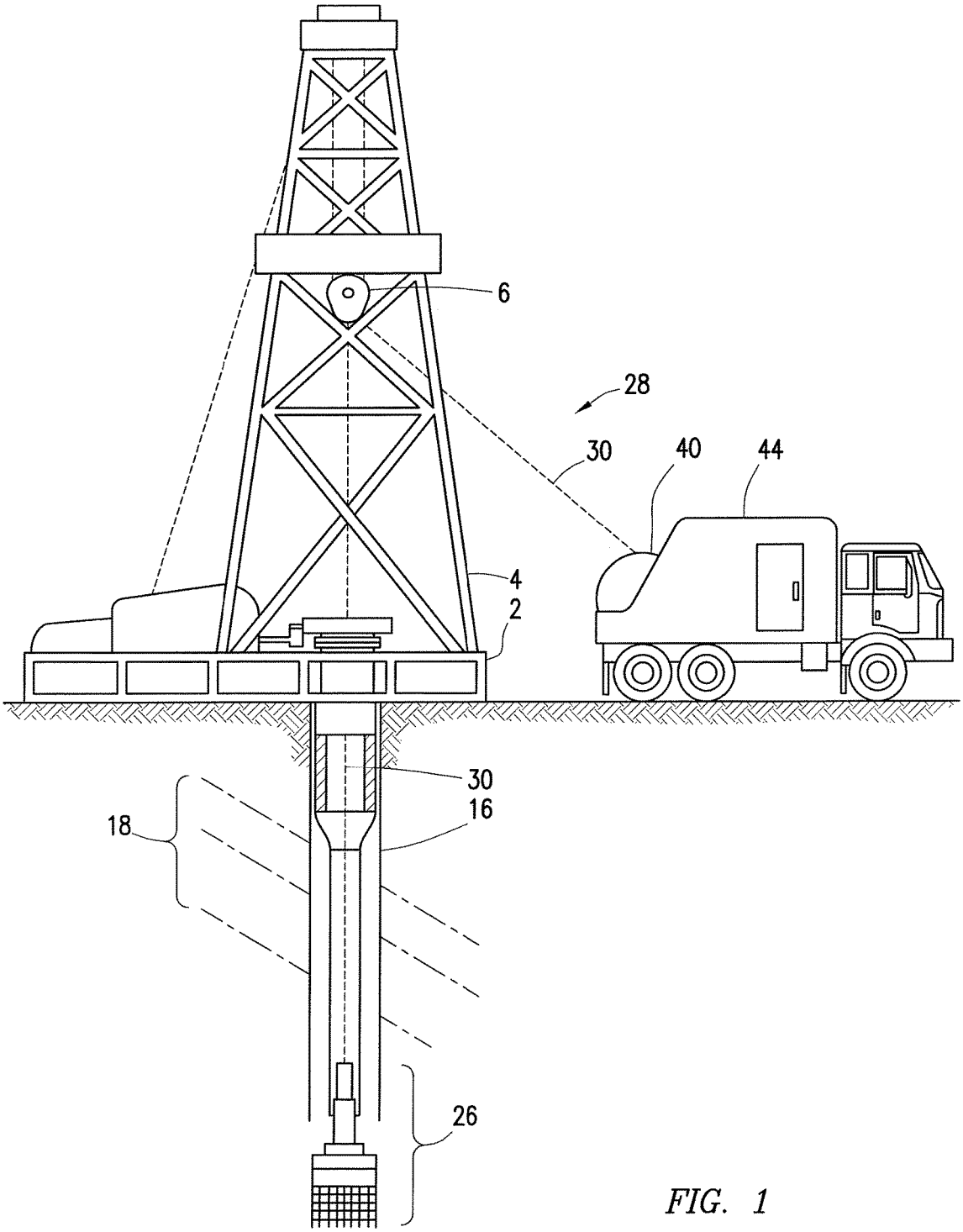
FIG. 1 is a schematic partial cross-sectional view of a slickline being deployed in a wellbore drilling environment, in accordance with an embodiment of the present disclosure.

Turning now to the drawings, FIG. 1 illustrates oil well equipment being used in an illustrative drilling environment. A drilling platform 2 supports a derrick 4 having a traveling block 6 for raising and lowering a drill string (not shown).

The drill string creates a wellbore 16 that passes through various formations 18. At various times during the drilling process, the drill string may be removed from the wellbore 16. Once the drill string has been removed, a subsurface device 26 (e.g., a plug, packer, etc.) may be lowered downhole to the desired setting depth via a conveying member 28. The subsurface device 26 may be used, for example, to seal off or isolate zones inside the wellbore 16. When the subsurface device 26 reaches the desired location within the wellbore 16, the subsurface device 26 is set in place within the wellbore 16. After the subsurface device 26 is securely set in place, the conveying member 28 may be retracted.

In present embodiments, the conveying member 28 includes a slickline 30, which is a nonelectric cable with a protective polymeric coating. The slickline 30 may be unspooled from a spool 40 on a slickline truck 44 onto a sheave (e.g., traveling block 6 or some other sheave) on the drilling platform 2. From here, the slickline 30 may be lowered (deployed) into the wellbore 16 and subsequently raised (retracted) from the wellbore 16 after placing the subsurface device 26 as described above. In presently disclosed embodiments, this slickline 30 may include an outer polymeric coating with additives and/or additional coatings used for identification, evaluation of the coating, and protection from intrusion of undesirable wellbore fluids.

FIG. 2 is a cross-sectional view of an embodiment of the slickline 30 used to convey well servicing equipment into the wellbore 16 of FIG. 1. The illustrated slickline 30 includes a central cable 50. The term "cable" refers to an elongated wire, bundle of wires, or material with fibers oriented along a longitudinal axis and designed to distribute tensile forces along the length of the cable while conveying drilling or well servicing equipment downhole. In some embodiments, the cable 50 may be a nonelectrical cable. In some embodiments, the cable 50 may be a fiber optic bundle, however other types of nonelectrical cables 50 may be used in other embodiments. In addition, the slickline 30 includes an intermediate layer 52 of material. The intermediate layer 52 adds bulk, mechanical support, and some protection to the inner cable 50. In some embodiments, the intermediate layer 52 may include a composite material. For example, the intermediate layer 52 may be formed from a thermoplastic polymer matrix such as polyphenylene sulfide (PPS) filled with carbon fibers. It should be noted that other types of materials and compositions may form this intermediate layer 52 in other embodiments of the slickline 30.

The slickline 30 also includes a doped polymeric coating 54 layered around the intermediate layer 52. The doped polymeric coating 54 is a different material from the material that makes up the intermediate layer 52. The doped polymeric coating 54 includes a polymeric material 56 doped with detectable elements 58. The polymeric material 56 may also be doped with elements for increasing the mechanical wear resistance of the slickline 30. In some embodiments, the polymeric material 56 may include a thermoplastic polymer, such as polyether ether ketone (PEEK). However, other types of polymeric material 56 may be used to form the doped polymeric coating 54. The detectable elements 58 in the doped polymeric coating 54 help to enhance the detectability of the doped polymeric coating 54 and to differentiate the doped polymeric coating 54 from the intermediate layer 52. This may be desirable during inspection of the doped polymeric coating 54, in order to ensure that any wear on the slickline 30 from the drilling environment does not extend through the doped polymeric coating 54 and into the intermediate layer 52.

The detectable elements 58 may be detectable via a corresponding detection machine. For example, in some embodiments of the slickline 30, the detectable elements 58 in the doped polymeric coating 54 may include electrically conductive elements that are detectable using an eddy current measurement device. In other embodiments, the detectable elements 58 may include elemental tracers that are detectable using an X-ray diffraction (XRD) machine or an X-ray fluorescence (XRF) machine.

The detectable elements 58 (or dopants) may be added to the polymeric coating 54 in a variety of concentrations, depending on the sensitivity of detection tools and other considerations. The concentration of the detectable elements 58 within the doped polymeric coating 54 is generally high enough to facilitate even dispersion of the detectable elements 58 within the polymeric material 56. In addition, the concentration of the detectable elements 58 within the doped polymeric coating 54 is large enough for the detection device to pick up on the detectable elements 58 and to determine when the coating is damaged. In some embodiments, the concentration of these dopants may be on the order of hundreds of parts per million. The concentration of the detectable elements 58 within the doped polymeric coating 54 may be between approximately 0.01% and 10%, between approximately 0.5% and 5%, or approximately 1%. Any desirable concentration of detectable elements 58 may be used, and an appropriate concentration may be determined based on the sensitivity of the device that will be used to detect the detectable elements 58 in the slickline 30.

As noted above, the detectable elements 58 that are added as dopants to the polymeric material 56 may be electrically conductive elements in some embodiments. These electrically conductive elements may be easily detectable through the induction of eddy currents using a magnetic eddy current detection device. The device may create an alternating magnetic field, which induces eddy currents in the conductive doped polymeric coating 54, and the device detects the presence or change in the eddy currents produced. In embodiments of the slickline 30 that have polymeric coatings doped with conductive elements, it may be desirable for the conductive element used to be highly electrically conductive. Examples of such conductive materials that may be used for doping the slickline coating include silver and copper, although other electrically conductive elements may be used as well. Such highly conductive dopants may give the illusion that the doped polymeric coating 54 is a conductor, thus enabling an eddy current detection device to detect the doped polymeric coating 54. When the eddy current detection device senses an abnormality in the conductivity of the doped polymeric coating 54, this may indicate that the doped polymeric coating 54 is damaged.

In addition, the detectable elements 58 in other embodiments may include elemental tracers that can be detected via an XRD or XRF machine. Such machines may bombard the doped polymeric coating 54 with X-rays and detect the diffracted X-rays (XRD machine) or secondary X-rays (XRF machine) to determine whether the desired elemental tracer is present in the coating. These XRD and XRF scanners can be used to monitor damage to the doped polymeric coating 54 by detecting abnormalities in the doped polymeric coating 54. It is desirable for the elemental tracers present within the doped polymeric coating 54 to be elements that are not naturally found in a downhole environment. Elements that are naturally found in the wellbore 16 include, among other, iron, chromium, silicon, or tin. The XRD or XRF detection machine may clearly distinguish the elemental tracers of the slickline 30 from fluids from the wellbore 16. In the event that the XRD or XRF machine picks up iron, chromium, silicon, tin, or other elements from the formation 18, this may indicate that the doped polymeric coating 54 has become impregnated with undesirable debris. Indeed, this may indicate that the doped polymeric coating 54 is damaged.

In order to further enhance the detection and evaluation of wear on the slickline 30, other embodiments of the slickline 30 may have multiple doped polymeric coatings 54 layered over one another. One example of this is illustrated in FIG. 3, which shows a slickline 30 having two doped polymeric coatings 54A and 54B disposed around the intermediate layer 52 and the cable 50. The doped polymeric coatings 54A and 54B include polymeric materials 56A and 56B, respectively, and these polymeric materials 56A and 56B may be the same material.

The first doped polymeric coating 54A disposed immediately adjacent the intermediate layer 52 may include different detectable elements 58A than the detectable elements 58B of the outer doped polymeric coating 54B. This may enable a detection machine (e.g., XRD or XRF machine) to determine whether the outer coating of the slickline 30 is damaged based on which of the two elemental tracers (e.g., detectable element 58A or detectable element 58B) is detected by the machine. That is, when the XRD or XRF detection machine detects only the outer detectable element 58B, this indicates that there is no significant damage to the coating of the slickline 30. However, when the detection machine detects the inner detectable element 58A at a portion of the slickline 30, this indicates that the coating of the slickline 30 at that portion is relatively worn.

In other embodiments, the ratio of detectable amounts of the detectable element 58A and the detectable element 58B are used to determine whether the slickline 30 is damaged. In such embodiments, the ratio of detectable amounts of the detectable elements 58A and 58B can be recorded for a newly fabricated slickline 30 as a function of axial length and radial position. These recorded ratios can then be referenced in normal operation of the slickline 30. Damage to the slickline 30 may be inferred when there is a detected change in the ratio of detectable amounts of element 58A and elements 58B as compared with the referenced ratio.

In embodiments of the slickline 30 with two doped polymeric coatings 54A and 54B layered over each other, it may be desirable for the detectable elements 58A and 58B of each layer, respectively, to have substantially different atomic numbers. For example, it may be desirable for the outer polymeric material 56B to be doped with silver and for the inner polymeric material 56A to be doped with rhenium. These detectable elements 58A (rhenium) and 58B (silver) have atomic numbers of 75 and 47, respectively. Thus, the detectable elements 58A and 58B are different enough that they would show up differently in the scans by XRD and XRF detection machines. In addition, the outer doped polymeric coating 54B, which contains silver, is also electrically conductive, making it detectable using an eddy current machine as well. Other combinations of detectable elements 58A and 58B may function as elemental tracers combined with polymeric materials in layers, as long as the detectable elements 58A and 58B have substantially different atomic numbers and do not include elements naturally formed in the wellbore 16. It should be noted that any desirable number of detectable elements 58 may be provided in concentric layers of doped polymeric coatings 54.

Figure 4:
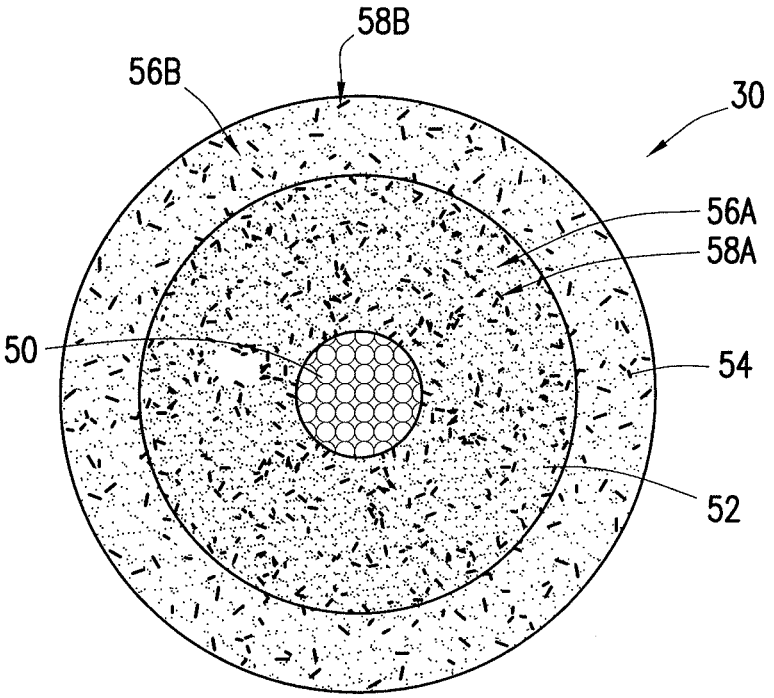
FIG. 4 is a schematic cross-sectional view of the slickline of FIG. 1 having a doped polymeric coating and a doped intermediate layer, in accordance with an embodiment of the present disclosure.

Another embodiment of the slickline 30 having two layers with different detectable elements 58A and 58B is illustrated in FIG. 4. In this illustrated embodiment, the first detectable element 58A is dispersed within the intermediate layer 52, while the outer detectable element 58B is dispersed in the doped polymeric coating 54. For example, the slickline 30 may include a rhenium dopant (first detectable element 58A) in the matrix of a carbon fiber reinforced polymer layer (intermediate layer 52) and silver (outer detectable element 58B) in a PEEK coating (doped polymeric coating 54). Other detectable elements and types of polymers may be used in the doped intermediate layer 52 and outer doped polymer coating 54 of FIG. 4. Furthermore, one or more additional layers of doped polymer coatings 54 having difference detectable elements 58 may be added to the outside of the illustrated slickline 30.

Figure 5:
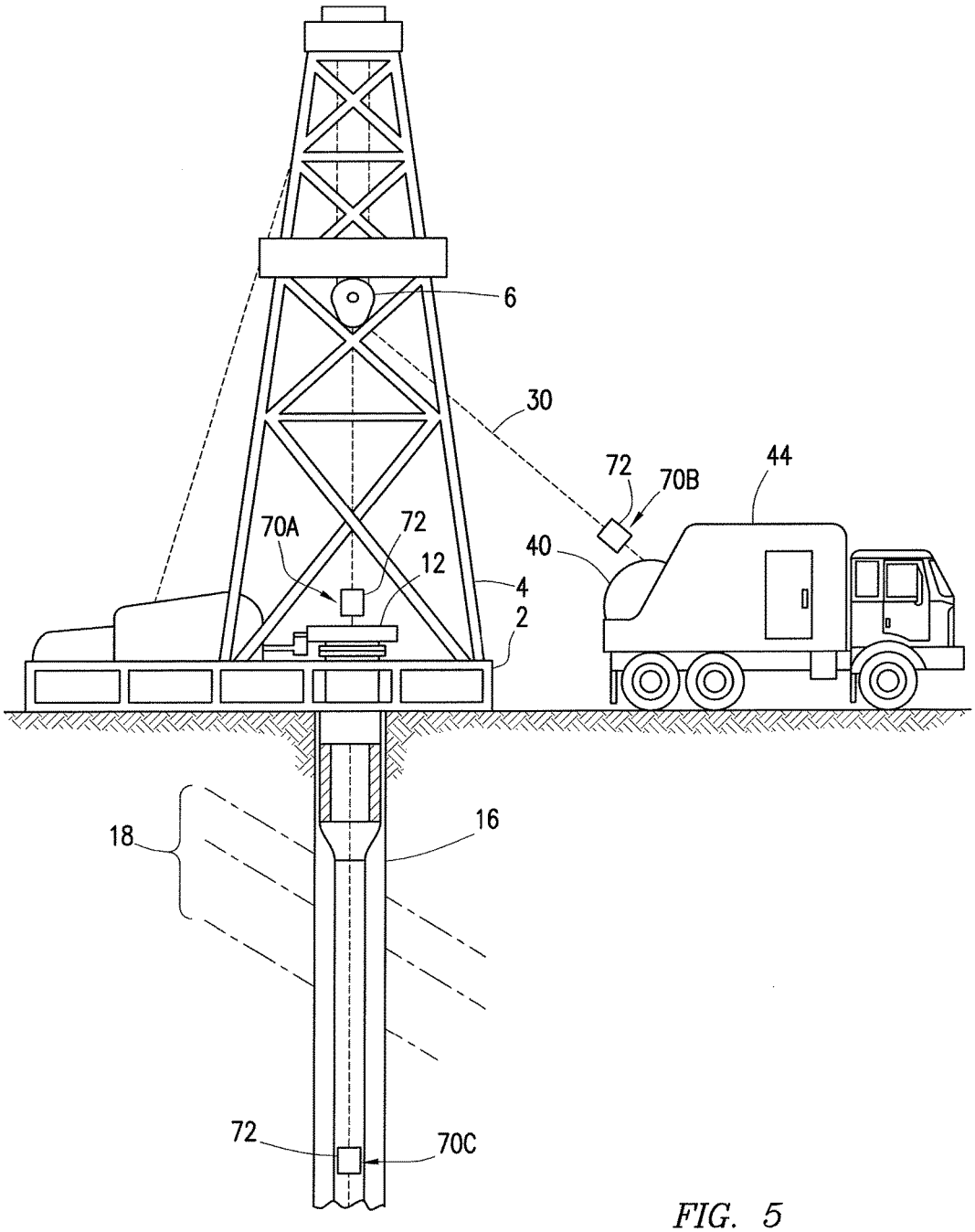
FIG. 5 is a schematic partial cross-sectional view of detection machines disposed in a wellbore drilling environment for detecting wear on the slickline of FIG. 1, in accordance with an embodiment of the present disclosure.

As discussed in detail above, a polymer coating of the slickline 30 may be doped with one or more detectable elements 58 (shown in FIGS. 2-4) so that a machine can detect the elements and determine whether the slickline 30 has become worn. An embodiment of the drilling platform 2 showing a number of possible locations 70 for such detection machines 72 is illustrated in FIG. 5. These detection machines 72, as described above, may include eddy current detection devices used to detect conductive elements present within an outer coating of the slickline 30. In other embodiments, the detection machines 72 may include XRD or XRF machines used to detect elemental tracers present within the outer coating of the slickline 30.

As illustrated in FIG. 5, detection machines 72 may clamp around or hover over the slickline 30 at various points along the drilling platform 2 where it is feasible and/or desirable to conduct the inspection of slickline cable 30 for damage. For example, it may be desirable for the detection machine 72 to be disposed between the spool 40 from which the slickline 30 is unspooled and the wellbore 16. The illustrated embodiment shows two such positions of the detection machines 72, one at a position 70A just above the wellhead of the wellbore 16 and another at a position 70B where the slickline 30 initially exits the spool 40. The detection machine 72 in the first position 70A may be coupled to the drilling platform 2. The detection machine 72 in the second position 70B may be coupled to the slickline truck 44. In still further embodiments, the detection machine 72 may be disposed in a position 70C within the wellbore 16, as illustrated by the detection machine 72. In other embodiments, the detection machine 72 may be located at an offsite inspection location (e.g., lab remote from the well site).

With at least one detection machine 72 disposed in any of the above described positions 70, the slickline 30 may be moved past the detection machine 72 during deployment or retraction of the slickline 30. As the slickline 30 moves through the detection machine 72, the detection machine 72 may detect a presence or an amount of an element in the coating of the slickline 30 moving past the detection machine 72. This element may be, for example, a conductive element and/or an elemental tracer. It may be desirable to determine whether the doped polymeric coating of the slickline 30 is damaged based on the presence or amount of the element detected by the detecting machine 72. In this way, the detection machine 72 may be used to constantly evaluate the integrity of the outer coating of the slickline 30 as the length of the slickline 30 moves past the detection machine 72. It should be noted that the detection machine 72 may include one or more onboard control components for determining whether the slickline 30 is worn or damaged, or the detection machine 72 may be in communication with a control component (not shown) on the drilling platform 2 or the slickline truck 44.

Other embodiments of the slickline 30 may include different additives provided to the outer coating of the slickline 30 in addition to, or in lieu of, the dopants described above. FIG. 6 is a cross-sectional view of one such embodiment of the slickline 30. The illustrated slickline 30 includes the cable 50 and the intermediate layer 52 described above. In addition, the slickline 30 includes a polymeric coating 90 layered around the intermediate layer 52. This polymeric coating 90 is a different material than the intermediate layer 52. For example, the intermediate layer 52 may include a reinforced thermoplastic polymer matrix such PPS filled with carbon fibers while the polymeric coating 90 includes a layer of PEEK, possibly with additives for increased strength. In the illustrated embodiment, the polymeric coating 90 is not doped with detectable elements as in previous embodiments. However, the slickline 30 includes an outer coating 92 disposed over the polymeric coating 90, this outer coating 92 being a hydrophobic coating or a hydrophilic coating.

The hydrophobic or hydrophilic outer coating 92 around the polymeric coating 90 may protect the cable 50 and other parts of the slickline 30 from harsh elements experienced in the wellbore 16. For example, the outer coating 92 makes the polymeric coating 90 more chemically resistant to additives that are introduced downhole. The outer coating 92 may also make the polymeric coating 90 resistant to various fluids from the formation 18. In certain embodiments, the outer coating 92 may be formed as a layer with a thickness on the order of a micron. The outer coating 92 may be applied to the slickline 30 as a spray or through dipping of the slickline 30 into the coating material.

In some embodiments, the outer coating 92 is hydrophobic, meaning that the outer coating 92 resists water. Thus, the hydrophobic outer coating may reduce water penetration so that the polymeric coating 90 does not absorb water, making the slickline 30 resistive to various wellbore fluids. The outer coating 92 may be applied directly to the polymeric coating 90. Acceptable hydrophobic materials that may be used for the outer coating 92 include manganese oxide polystyrene (MnO2/PS) nano-composite, zinc oxide polystyrene (ZnO/PS) nano-composite, precipitated calcium carbonate, carbon nano-tube structures, and silica nano-coating. Other types of hydrophobic compounds may be used for the outer coating 92 in other embodiments of the slickline 30. Silica based hydrophobic coatings may be relatively simple to apply to the slickline 30 and are relatively inexpensive. Indeed, gel-based coatings may be easily applied by dipping the slickline 30 into gel or using an aerosol spray. It should be noted, however, that oxide polystyrene composites may be relatively more durable than gel-based coatings, although the process for applying these composites may be more involved and expensive.

As noted above, in some embodiments, the outer coating 92 is hydrophilic, meaning that the outer coating 92 attracts water while resisting other chemical compounds. Specifically, such hydrophilic outer coatings may resist oil penetration into the slickline 30 from the wellbore environment. Acceptable hydrophilic materials that may be used for the outer coating 92 include titanium nitride, hyaluronic acid ((C14H21NO11)n) based products, and AQUAGLIDE™. Other types of hydrophilic coatings may be used for the outer coating 92 in other embodiments of the slickline 30.

The embodiment of the slickline 30 illustrated in FIG. 6 features the hydrophobic or hydrophilic outer coating 92 disposed over the polymeric coating 90 that is not doped with detectable elements. However, as shown in FIG. 7, other embodiments of the slickline 30 include the hydrophobic or hydrophilic outer coating 92 applied to the outside of the doped polymeric coating 54 having the polymeric material 56 doped with elements 58 that are detectable using a detection machine 72 (shown in FIG. 5). The dopant elements 58 may still be detectable under the thin hydrophobic or hydrophilic outer coating 92. Thus, the illustrated slickline 30 may feature enhanced detectability of wear on the polymeric layer of the slickline 30 as well as enhanced protection against the elements of the wellbore environment. In another embodiment, two outer coatings are added to the slickline 30. The first coating is a thin hydrophobic coating while the second is a thin hydrophilic outer coating. This offers the benefit of protecting the slickline 30 from both water and oil penetration.

Figure 8:
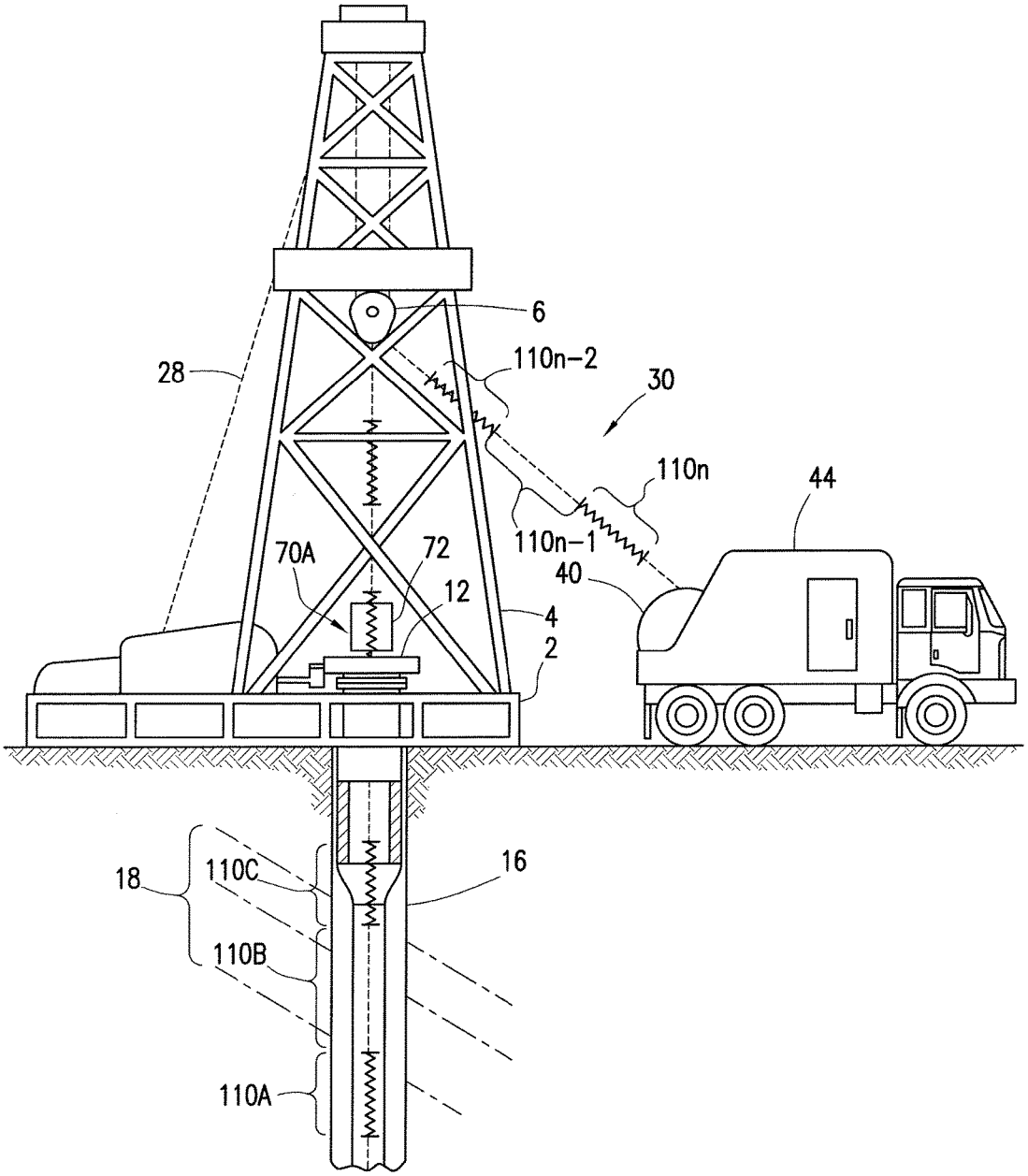
FIG. 8 is a schematic partial cross-sectional view of a slickline being deployed in a wellbore drilling environment, the slickline having various dopants for indicating zones of the slickline, in accordance with an embodiment of the present disclosure.

FIG. 8 illustrates another embodiment of the slickline 30 having a doped polymer coating. In the illustrated embodiment, the polymer coating is doped with different detectable elements along the length of the slickline 30. Thus, the slickline 30 features different zones 110 defined by the particular dopant used in those zones 110 (e.g., 110A, 110B, 110C, . . . 110*n*−2, 110*n*−1, 110*n*). For example, the zones 110 may have alternating silver-doped polymer coatings (e.g., on zones 110A, 110C, . . . ) and rhenium-doped polymer coatings (e.g., 110B, . . . ). Other types of dopants may be used to form the zones 110 along the length of the slickline 30. In the illustrated embodiment, the drilling platform 2 includes the detection machine 72 disposed at the first location 70A just above the wellhead. As the slickline 30 is unspooled from the spool 40 and lowered into the wellbore 16, the different zones 110 pass the detection machine 72. The detection machine 72 may determine, based on the sensed elements in the doped coating of the slickline 30, when the slickline 30 passes from one zone 110 to the next into the wellbore 16. Using this information, a control component (onboard the detection machine 72 or on the drilling platform 2) may approximate a depth of the slickline 30 disposed in the wellbore 16. The control component may also tag specific locations along the length of the slickline 30 where damage or wear on the slickline 30 is identified.

Although the present disclosure and its advantages have been described in detail, it should be understood that various changes, substitutions and alterations can be made herein without departing from the spirit and scope of the disclosure as defined by the following claims.

What is claimed is:

1. A slickline, comprising:

a cable;

an intermediate layer disposed around the cable; and a first doped polymeric coating layered around the intermediate layer, wherein the first doped polymeric coating comprises a different material from the intermediate layer, and wherein the first doped polymeric coating comprises a polymeric material doped with an element that is detectable within the first doped polymeric coating via a detection machine.

2. The slickline of claim 1, wherein the first doped polymeric coating comprises the polymeric material doped with a conductive material in a concentration that is detectable via an eddy current measurement device.

3. The slickline of claim 1, wherein the first doped polymeric coating comprises the polymeric material doped with an elemental tracer in a concentration that is detectable via an X-ray diffraction (XRD) or X-ray fluorescence (XRF) machine.

4. The slickline of claim 3, wherein the elemental tracer does not comprise iron, chromium, silicon, or tin.

5. The slickline of claim 3, comprising a second doped polymeric coating layered around the first doped polymeric coating, wherein the first doped polymeric coating comprises the polymeric material doped with a first elemental tracer and wherein the second doped polymeric coating comprises the polymeric material doped with a second elemental tracer, wherein an atomic number of the first elemental tracer is different from an atomic number of the second elemental tracer such that the first and second elemental tracers are distinguishable from each other via an XRD machine or an XRF machine.

6. The slickline of claim 3, wherein the first doped polymeric coating comprises the polymeric material doped with a first elemental tracer and wherein the intermediate layer is doped with a second elemental tracer, wherein an atomic number of the first elemental tracer is different from an atomic number of the second elemental tracer such that the first and second elemental tracers are distinguishable from each other via an XRD machine or an XRF machine.

7. The slickline of claim 3, wherein the first doped polymeric coating is layered around the intermediate layer along a first lengthwise zone of the slickline, and wherein a second doped polymeric coating is layered around the intermediate layer along a second lengthwise zone of the slickline adjacent the first lengthwise zone, wherein an atomic number of the first elemental tracer is different from an atomic number of the second elemental tracer such that the first and second elemental tracers are distinguishable from each other via an XRD machine or an XRF machine.

8. The slickline of claim 1, comprising a hydrophobic or hydrophilic coating disposed over the first doped polymeric coating.

9. A slickline, comprising:

a cable;

an intermediate layer disposed around the cable;

a polymeric coating layered around the intermediate layer, wherein the polymeric coating comprises a different material from the intermediate layer; and an outer coating disposed over the polymeric coating, wherein the outer coating comprises a hydrophobic coating or a hydrophilic coating.

10. The slickline of claim 9, wherein the outer coating comprises manganese oxide polystyrene, zinc oxide polystyrene, precipitated calcium carbonate, carbon nano-tube structures, silica nano-coating, titanium nitride, or a hyaluronic acid based product.

11. The slickline of claim 9, wherein the outer coating comprises a gel-based coating.

12. The slickline of claim 9, wherein the outer coating comprises a hydrophobic coating disposed over the polymeric coating and a hydrophilic coating disposed over the hydrophobic coating.

13. The slickline of claim 9, wherein the polymeric coating comprises a polymeric material doped with an element that is detectable within the polymeric coating via an eddy current measurement device, an X-ray diffraction (XRD) machine, or an X-ray fluorescence (XRF) machine.

14. A method for detecting wear on a slickline, comprising:

moving the slickline past a detection machine during deployment or retraction of the slickline from a wellbore, wherein the slickline comprises:

a cable;

an intermediate layer disposed around the cable; and a first doped polymeric coating layered around the intermediate layer, wherein the first doped polymeric coating comprises a different material from the intermediate layer, and wherein the first doped polymeric material comprises a polymeric material doped with a detectable element that is detectable within the first doped polymeric coating via the detection machine;

detecting, via the detection machine, a presence or an amount of the detectable element in the first doped polymeric coating of the slickline moving past the detection machine; and determining whether the first doped polymeric coating of the slickline is damaged based on the presence or amount of the detectable element detected by the detecting machine.

15. The method of claim 14, wherein the detection machine comprises an eddy current measurement device that detects a conductivity of the first doped polymeric coating of the slickline, or an X-ray diffraction (XRD) or X-ray fluorescence (XRF) machine that detects an elemental tracer in the first doped polymeric coating of the slickline.

16. The method of claim 14, comprising determining the first doped polymeric coating of the slickline is damaged when the detection machine detects elements of a subterranean formation in the first doped polymeric coating of the slickline.

17. The method of claim 14, comprising determining the first doped polymeric coating of the slickline is damaged when the detection machine detects a change in a ratio of the detectable element.

18. The method of claim 14, wherein the slickline comprises a hydrophobic or hydrophilic coating layered over the first doped polymeric coating of the slickline.

19. The method of claim 14, further comprising moving the slickline past the detection machine via a spool during deployment or retraction of the slickline from the wellbore, wherein the detection machine is disposed between the spool and the wellbore.

20. The method of claim 14, wherein the detection machine is disposed within the wellbore.

* * * * *